US007589582B2

(12) United States Patent
Ahn

(10) Patent No.: US 7,589,582 B2
(45) Date of Patent: Sep. 15, 2009

(54) MULTI-LEVEL VOLTAGE GENERATOR

(75) Inventor: Sang Wook Ahn, Seongnam-si (KR)

(73) Assignee: Syncoam, Co., Ltd, Seongnam-si (KR)

( * ) Notice: Subject to any disclaimer, the term of this patent is extended or adjusted under 35 U.S.C. 154(b) by 198 days.

(21) Appl. No.: 11/572,396

(22) PCT Filed: Dec. 27, 2004

(86) PCT No.: PCT/KR2004/003458

§ 371 (c)(1),
(2), (4) Date: Jan. 19, 2007

(87) PCT Pub. No.: WO2006/014045

PCT Pub. Date: Feb. 9, 2006

(65) Prior Publication Data

US 2008/0303587 A1 Dec. 11, 2008

(30) Foreign Application Priority Data

Aug. 4, 2004 (KR) ..... 10-2004-0061283

(51) Int. Cl.
*G05F 1/10* (2006.01)
*G05F 3/02* (2006.01)

(52) U.S. Cl. ..... 327/536

(58) Field of Classification Search ..... 327/536
See application file for complete search history.

(56) References Cited

U.S. PATENT DOCUMENTS 5,861,861 A 1/1999 Nolan et al.
5,999,040 A * 12/1999 Do et al. ..... 327/536
6,236,394 B1 5/2001 Ikeda
6,483,282 B1 * 11/2002 Bayer ..... 323/315
7,005,912 B2 * 2/2006 Nonaka ..... 327/536

FOREIGN PATENT DOCUMENTS

KR 1020010050298 6/2001

OTHER PUBLICATIONS

PCT International Search Report for International Application No. PCT/KR2004/003458; Date of Mailing International Search Report: Apr. 30, 2005.
PCT Written Opinion of the International Searching Authority for International Application No. PCT/KR2004/003458; Date of Mailing: Apr. 30, 2005.

* cited by examiner

*Primary Examiner*—Quan Tra
(74) *Attorney, Agent, or Firm*—Jae Y. Park; Kile Goekjian Reed & McMan

(57) ABSTRACT

A multilevel voltage generator includes a first positive voltage generator generating a first output voltage using a first capacitor which receives a reference voltage and is charged to a voltage level corresponding to two times of the reference voltage, a second positive voltage generator generating a second output voltage and a third output voltage using a second capacitor and a third capacitor which receive the first output voltage and are charged to voltage levels corresponding to predetermined multiples of the reference voltage, and a negative voltage generator generating a fourth output voltage having predetermined negative voltage levels using a fourth capacitor which receives the reference voltage, the second output voltage, or the third output voltage and is charged to a voltage level corresponding to a negative voltage of the second or third output voltage.

2 Claims, 8 Drawing Sheets

[Fig. 1]
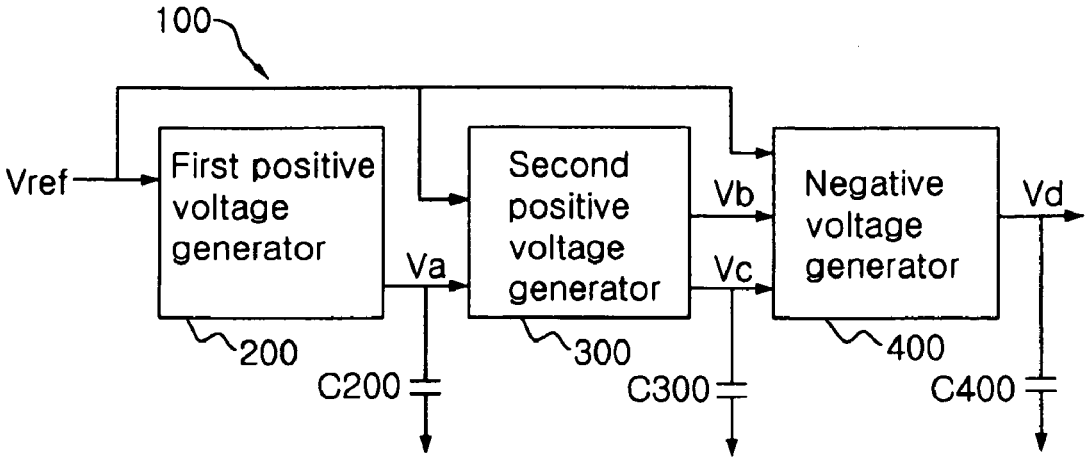
[Fig. 2]
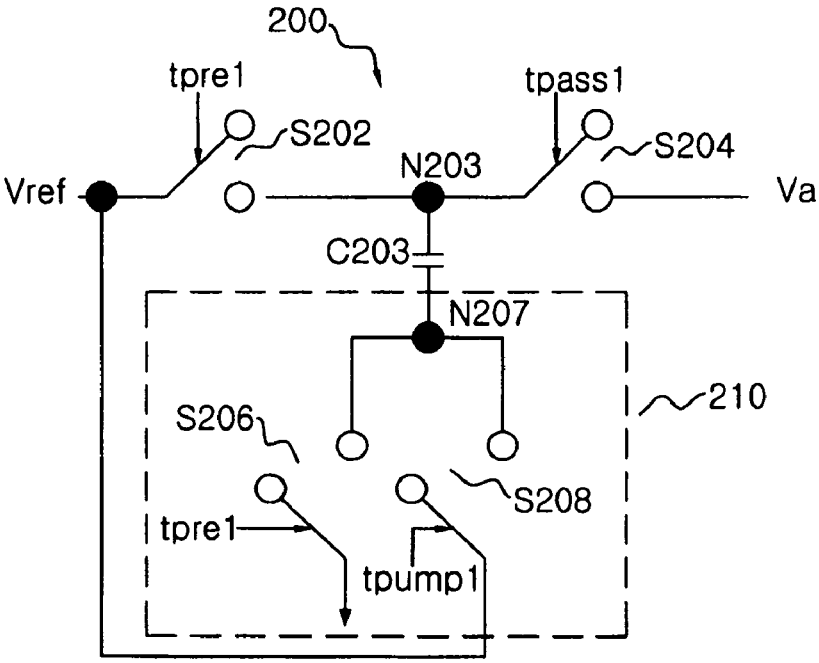

[Fig. 3]
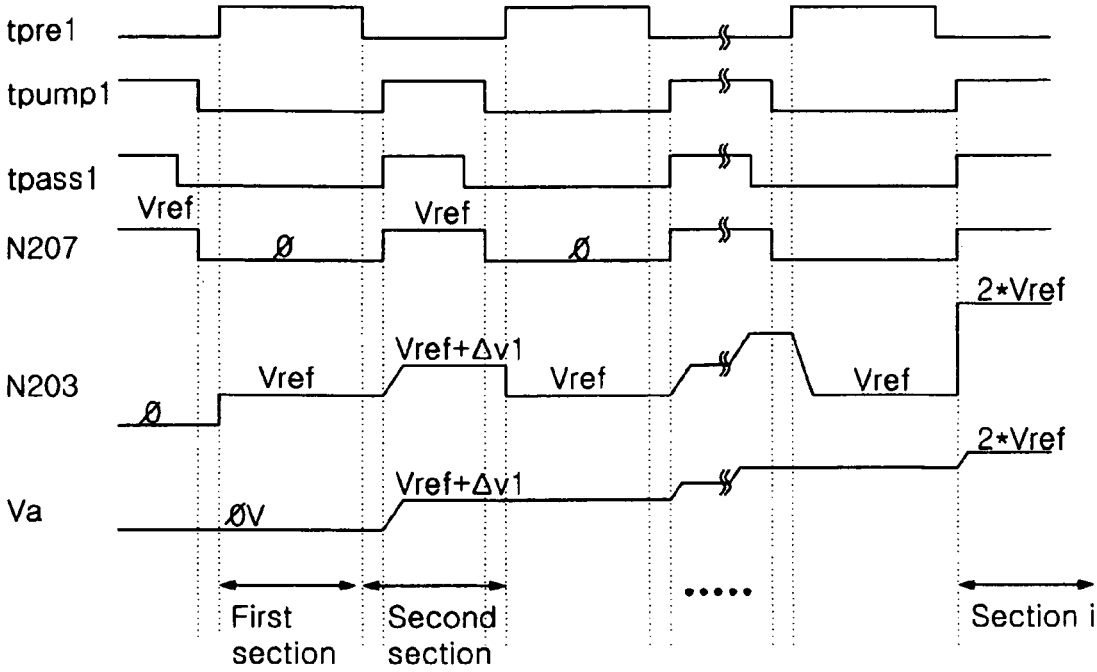
[Fig. 4]
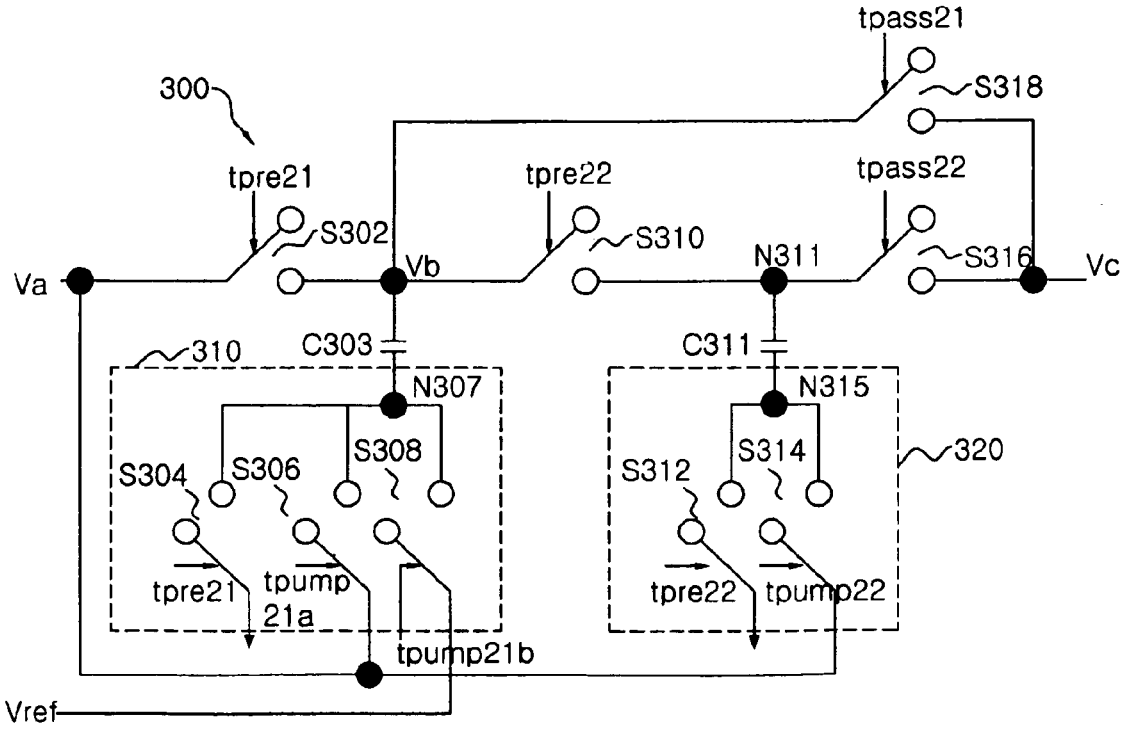

[Fig. 5]
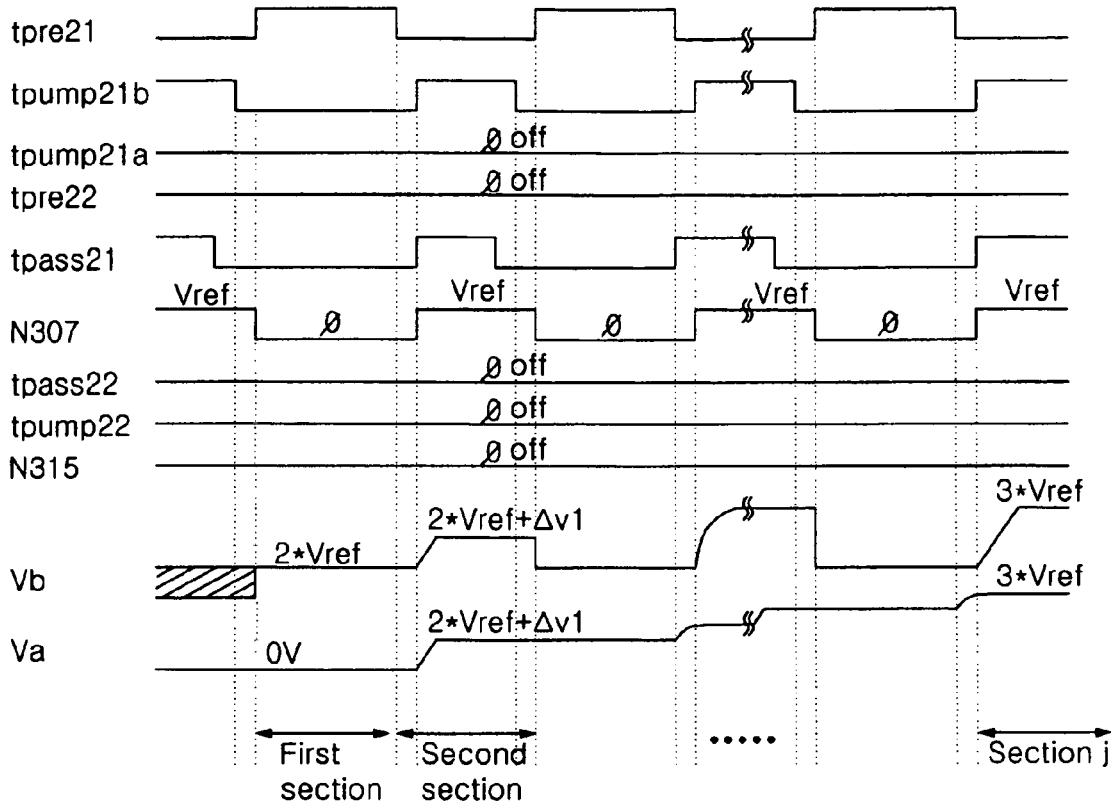
[Fig. 6]
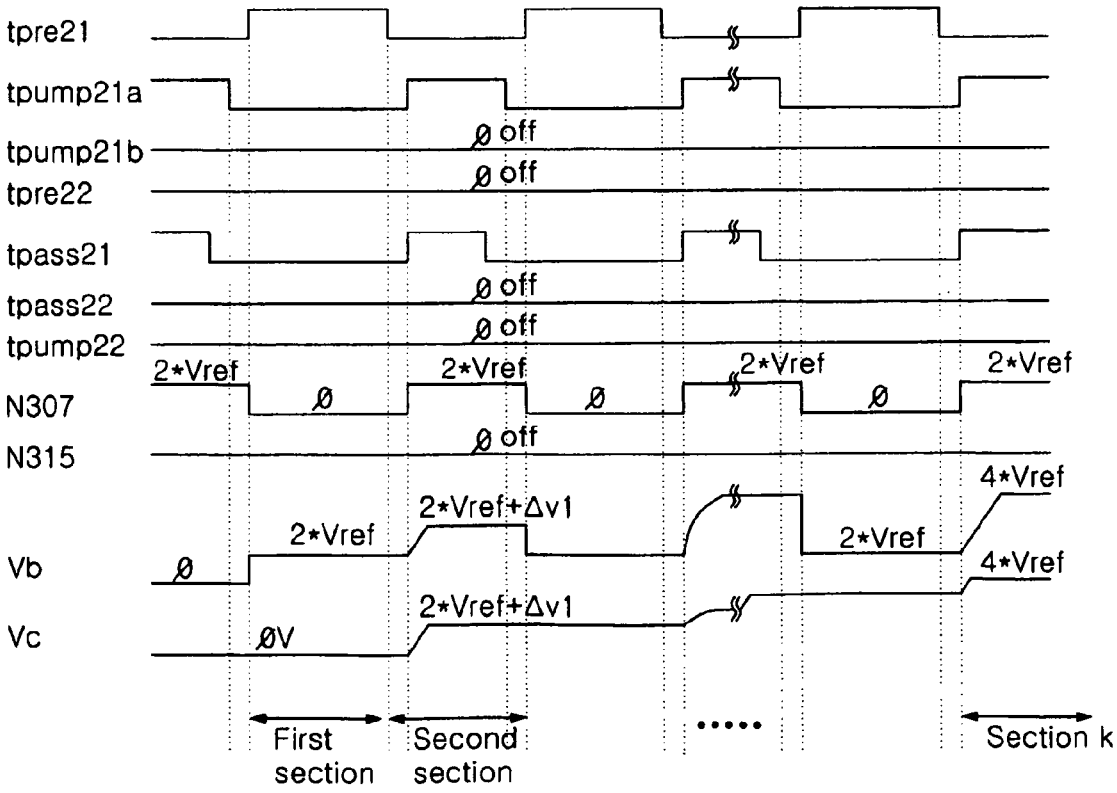

[Fig. 7]
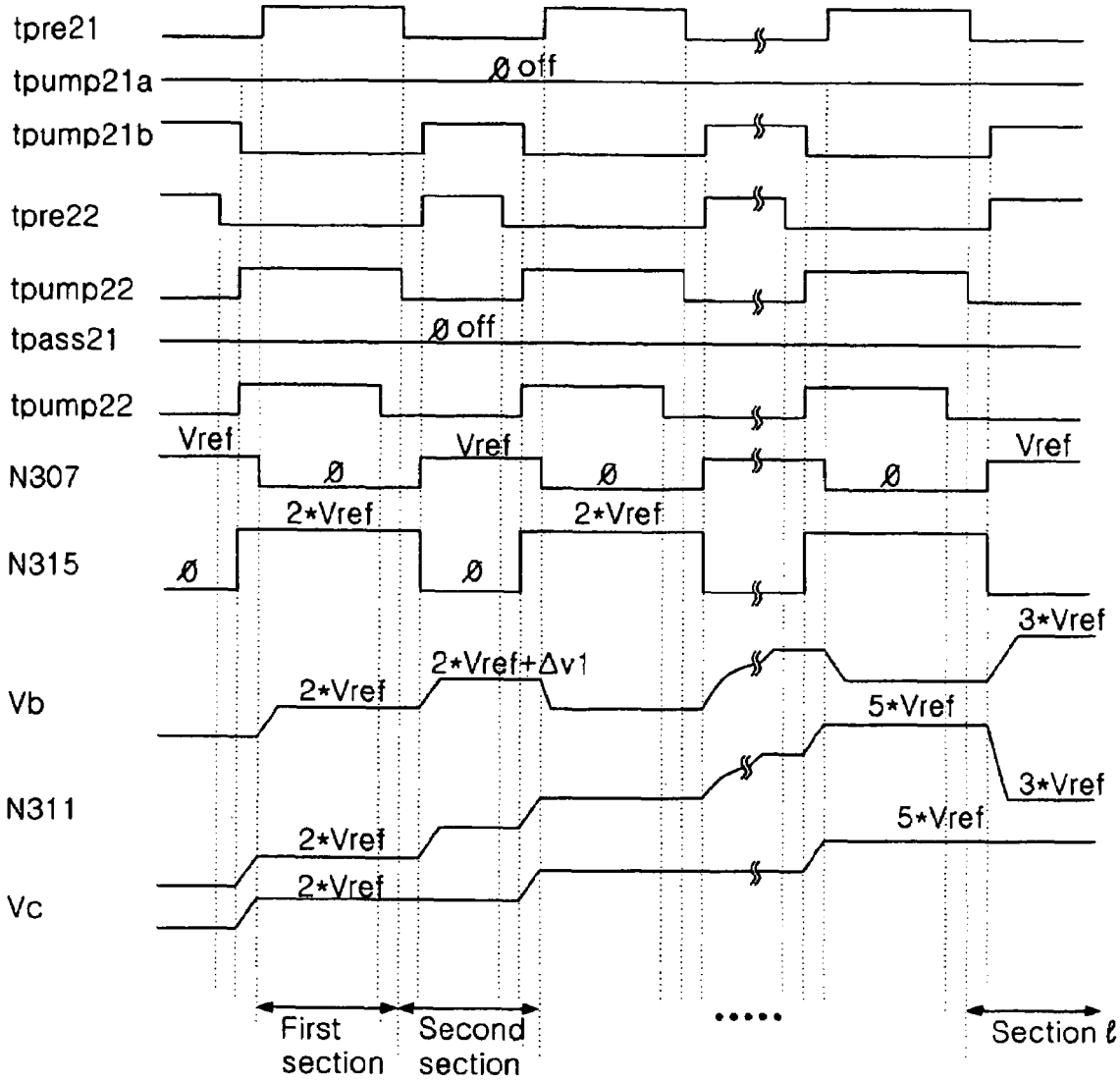

[Fig. 8]
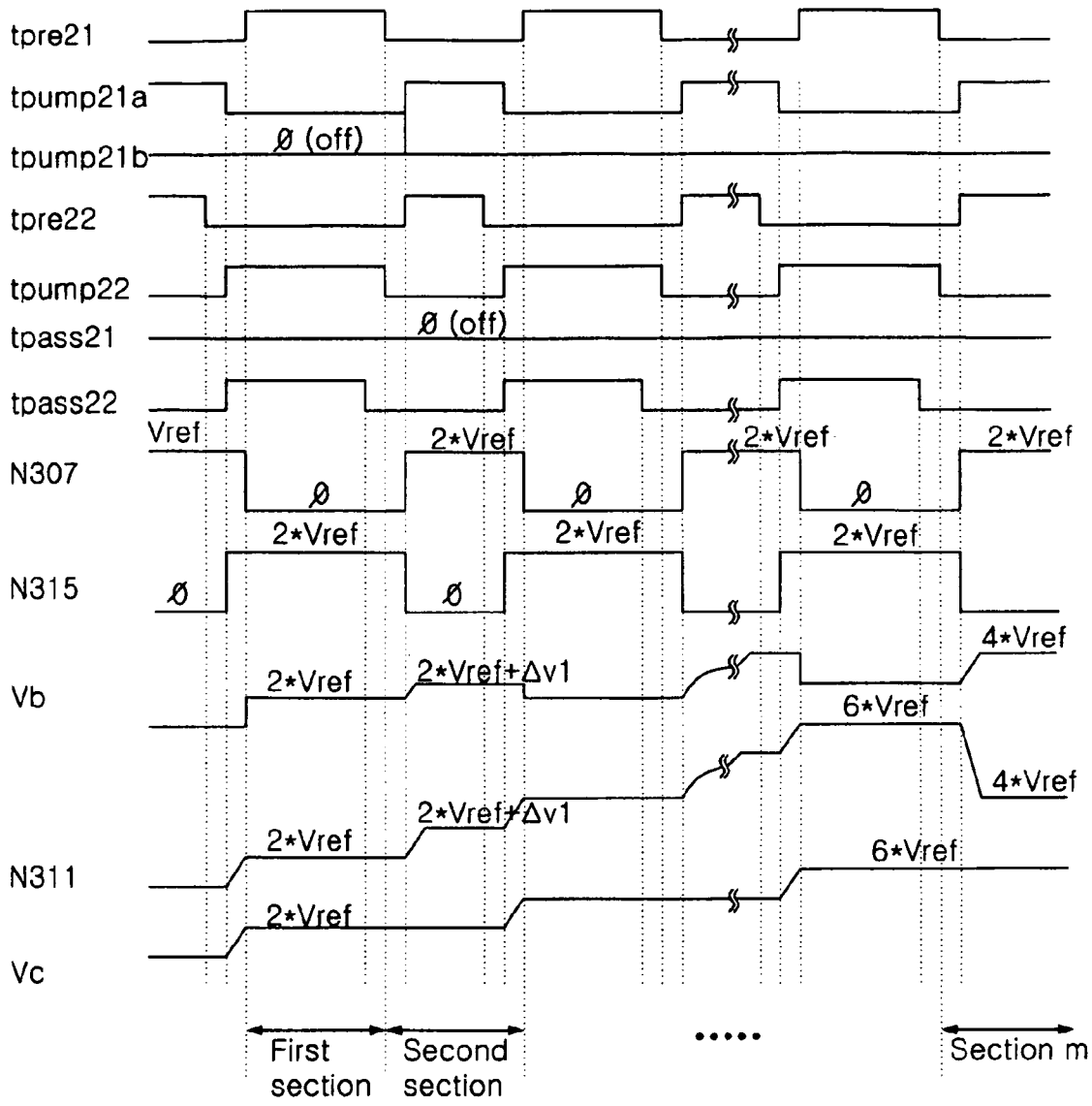

[Fig. 9]
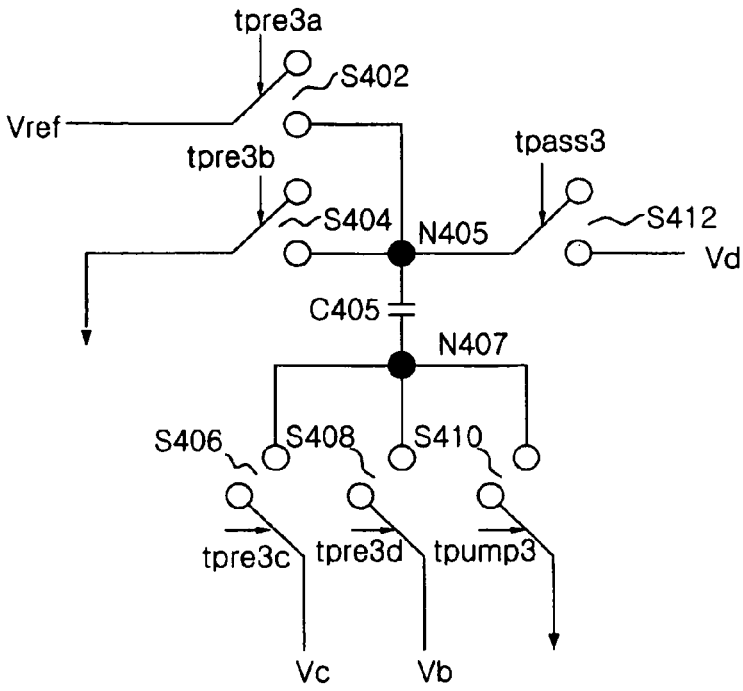
[Fig. 10]
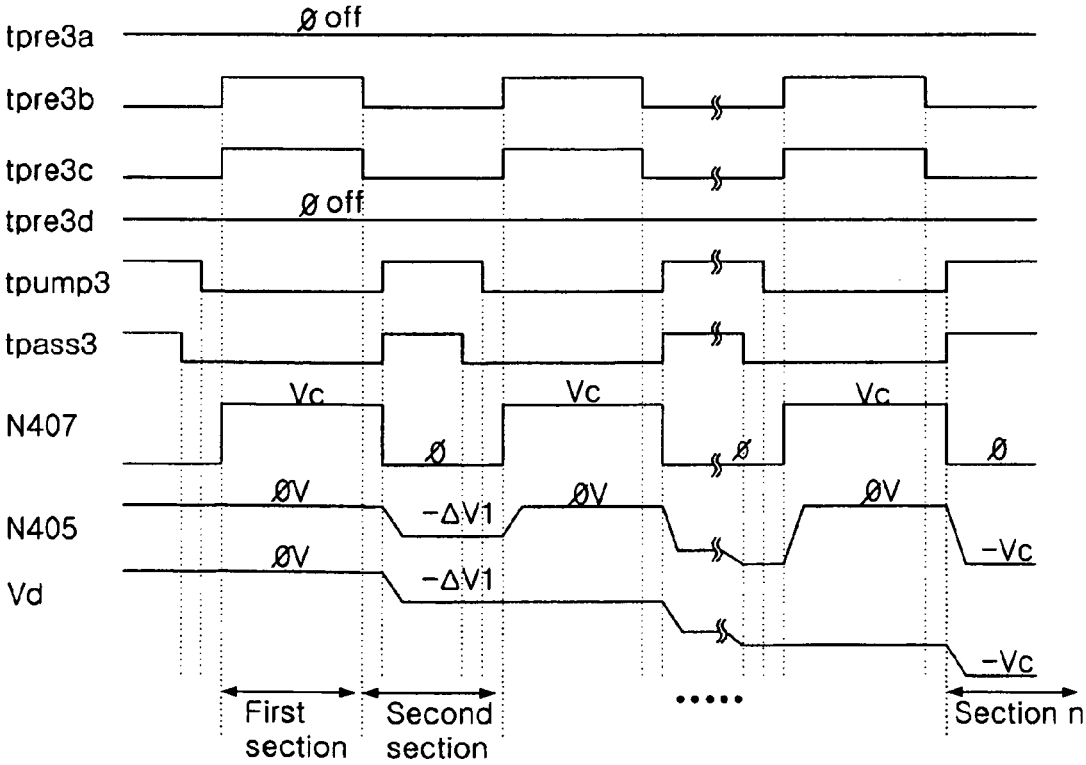

[Fig. 11]
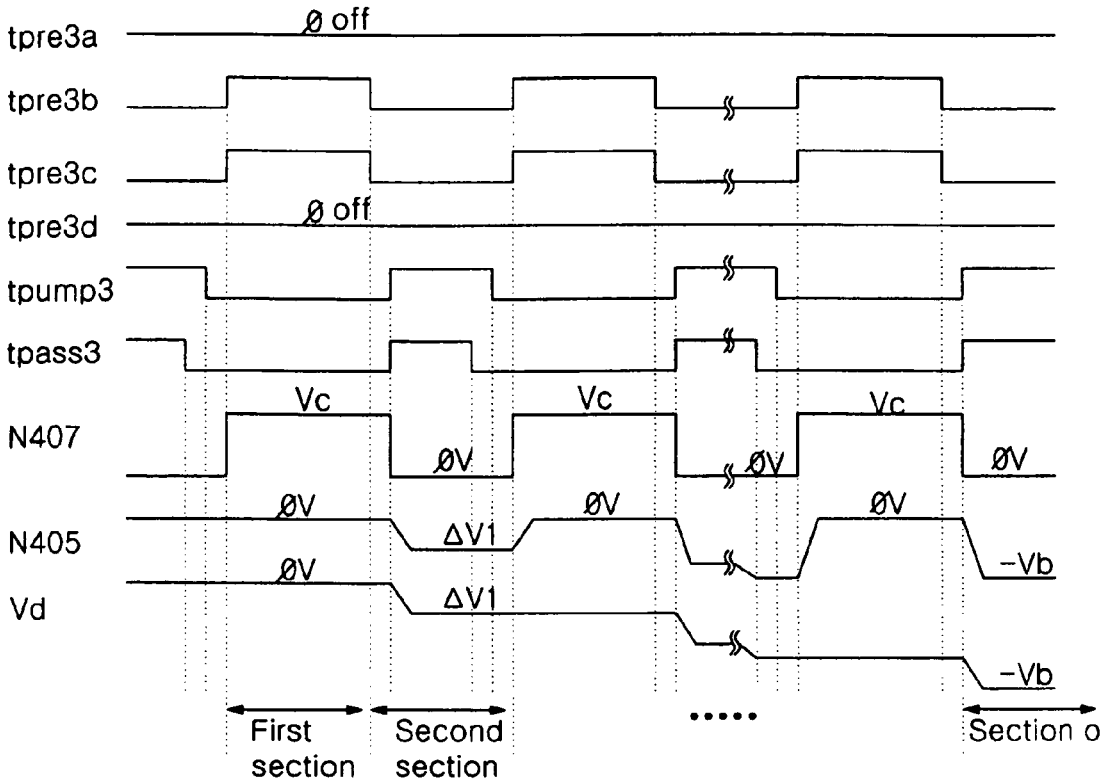
[Fig. 12]
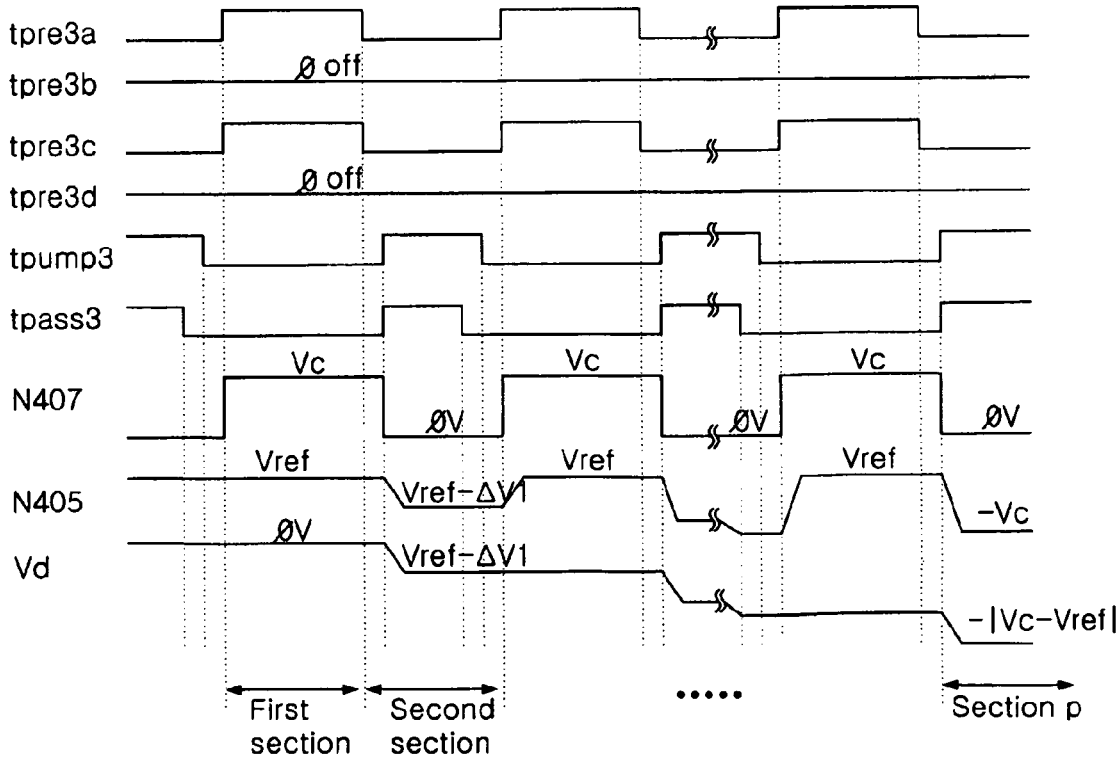

[Fig. 13]
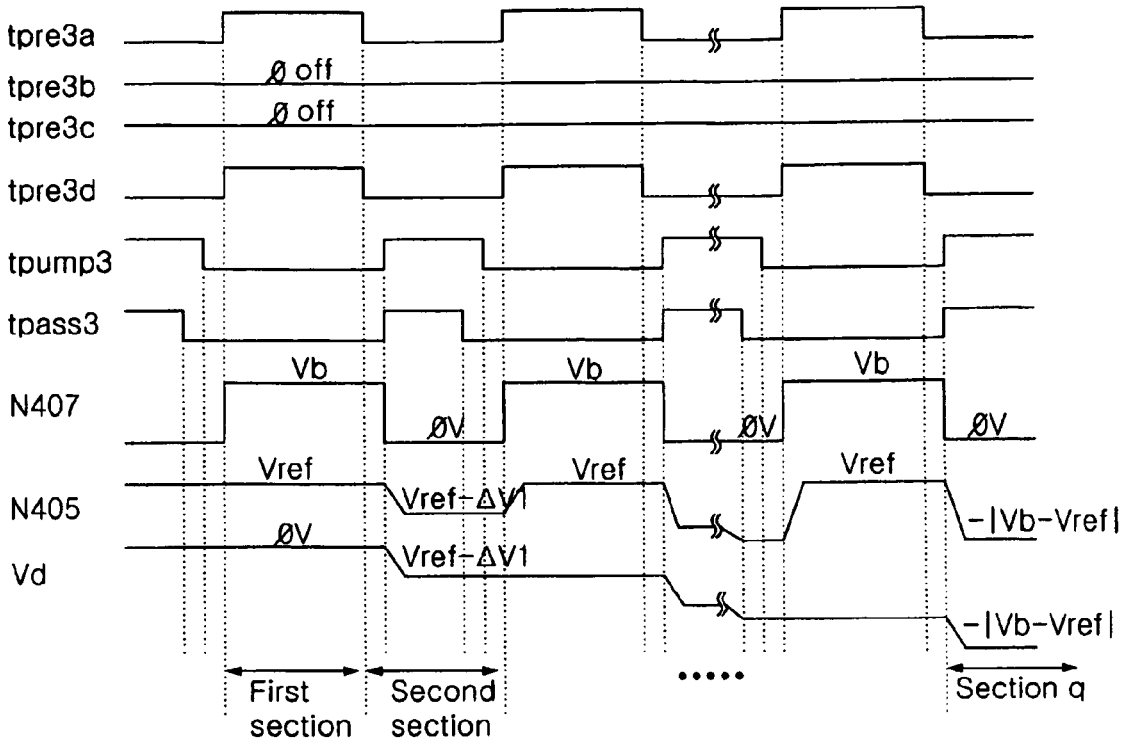

MULTI-LEVEL VOLTAGE GENERATOR

BACKGROUND OF THE INVENTION

1. Field of the Invention

The present invention relates to an electronic circuit, and more particularly, to a multilevel voltage generator for generating a variety of voltage levels.

2. Description of the Related Art

A liquid crystal display (LCD) device that is a display device among electronic circuit apparatuses displays an image by controlling light transmissivity of liquid crystal using an electric field. To this end, the LCD device includes a liquid crystal panel in which liquid cells are arranged in a matrix format and a driving circuit for driving the liquid crystal panel.

The liquid crystal panel includes a thin film transistor formed at each of cross-points of gate lines and data lines and the liquid crystal cell connected to the thin film transistor. A gate electrode of the thin film transistor is connected to any one of the data lines in units of horizontal lines while a source electrode is connected to any one of the data lines in units of vertical lines. The thin film transistor supplies a pixel voltage signal from the data line to the liquid crystal cell in response to a scan signal from the gate line.

In order to drive the thin film transistor type LCD device (hereinafter, referred to as "TFr-LCD"), a gate drive for driving the gate lines of the thin film transistor and a source driver for driving the source lines of the thin film transistor are provided. The gate driver turns on the thin film transistor by applying a high voltage and the source driver applies an analog pixel signal to indicate color to the source line, so that an image is displayed on the TFT-LCD.

The source driver sequentially latches digital pixel data in response to a Sampling data, converts the latched digital pixel data to an analog pixel signal, and buffers and outputs the analog pixel signal. In particular, the source driver outputs a voltage corresponding to pixel data input of voltages V1-V64 corresponding to all bit combination of, for example, 6 bit pixel data, as a pixel signal. For this operation, the source driver includes blocks which are driven with a power of a variety of voltage levels.

The driving circuits such as the gate driver or the source driver need a variety of voltage levels and a multilevel voltage generator for generating a variety of voltage levels has been widely known. However, in accordance with the miniaturization of electronic circuit apparatuses, a multilevel voltage generator which can generate a variety of voltage levels with a reduced number of constituent elements is required.

SUMMARY OF THE INVENTION

To solve the above and/or other problems, the present invention provides a multilevel voltage generator with a reduced number of constituent elements.

According to an aspect of the present invention, a multilevel voltage generator comprises a first positive voltage generator generating a first output voltage using a first capacitor which receives a reference voltage and is charged to a voltage level corresponding to two times of the reference voltage, a second positive voltage generator generating a second output voltage and a third output voltage using a second capacitor and a third capacitor which receive the first output voltage and are charged to voltage levels corresponding to predetermined multiples of the reference voltage, and a negative voltage generator generating a fourth output voltage having predetermined negative voltage levels using a fourth capacitor which receives the reference voltage, the second output voltage, or the third output voltage and is charged to a voltage level corresponding to a negative voltage of the second or third output voltage.

BRIEF DESCRIPTION OF THE DRAWINGS

FIG. 1 is a circuit diagram of a multilevel voltage generator according an embodiment of the present invention;

FIG. 2 is a circuit diagram of a first positive voltage generator of FIG. 1;

FIG. 3 is an operation timing diagram of the first positive voltage generator of FIG. 2;

FIG. 4 is a circuit diagram of a second positive voltage generator of FIG. 1;

FIGS. 5 through 8 are operation timing diagrams of the second positive voltage generator of FIG. 4;

FIG. 9 is a circuit diagram of a negative voltage generator of FIG. 1; and FIGS. 10 through 13 are timing diagrams of the negative voltage generator of FIG. 9.

DETAILED DESCRIPTION OF THE INVENTION

Referring to FIG. 1, a multilevel voltage generator 100 according to an embodiment of the present invention receives a reference voltage Vref and generates output voltages Va–Vd corresponding to a multiple of a level of the reference voltage Vref using a charge pumping method. The multilevel voltage generator 100 includes three steps of positive (+) voltage generators 100, 200, and 300 and capacitors C200, C300, and C400.

The first positive (+) voltage generator 100 receives the reference voltage Vref, generates a first output voltage Va as its output, and charges the capacitor C200 with the first output voltage Va. The second positive (+) voltage generator 200 receives the reference voltage Vref and the first output voltage Va, generates a second output voltage Vb and a third output voltage Vc, and charges the capacitor C300 with the third output voltage Vc. The negative (−) voltage generator 400 receives the reference voltage Vref and the second and third output voltages Vb and Ve, generates a fourth output voltage Vd, and charges the capacitor C400 with the fourth output voltage Vd.

The first positive voltage generator 100 receives the reference voltage Vref and generates the first output voltage Va having a level double the reference voltage Vref (2×Vref), which is shown in FIG. 2. Referring to FIG. 2, the first positive voltage generator 100 includes first through fourth switches S202, S204, S206, and S208 and a first capacitor C203. The first switch S202 transfer the reference voltage Vref to a node N203 in response to a first control signal tpre1. The reference voltage Vref transferred to the node N203 is charged in the first capacitor C203. The first capacitor C203 is connected between a node N207 and the node N203 and coupled to a voltage levels of the nodes N203 and N207. The voltage level of the node N203 is transferred to the first output Va through the second switch S204 responding to a third control signal tpass1. The node N207 is connected to the third switch S206 responding to the first control signal tpre1 and the fourth switch S208 responding to a second control signal tpimp1. The fourth switch S208 transfers the reference voltage Vref to the node N207 in response to the second control signal tpump1. The third switch S206 and the fourth switch S208 constitute a first level transfer portion 210 which transfers a ground voltage VSS or the reference voltage Vref.

FIG. 3 is an operation timing diagram of the first positive voltage generator 200 of FIG. 2. Referring to FIG. 3, in a first section, while the first control signal tpre1 is a logic high level and the second and third control signals tpump1 and tpass1 are logic low levels, the node N207, the node N203, and the first output voltage Va are indicated as 0V, a Vref level, and 0V, respectively. In a second section, while the first control signal tpre1 is a logic low level and the second and third control signals tpump1 and tpass1 are logic high levels, the node N207, the node N203, and the first output voltage Va are indicated as a Vref level, a Vref+ΔV1 level, and the Vref+ΔV1 level, respectively. After the first and second sections are repeated several times, in a section i, the node N203 and the first output voltage Va are indicated as a 2×Vref level.

FIG. 4 is a circuit diagram of a second positive voltage generator of FIG. 1. Referring to FIG. 4, the second positive voltage generator 300 includes fifth through thirteenth switches S302, S304, S306, S308, S310, S312, S314, S316, and S318 and second and third capacitors C303 and C311. The fifth switch S302 transfers the first output voltage Va output from the first positive voltage generator 200 to the second output Vb in response to a fourth control signal tpre21. The second capacitor C303 is connected between the second output Vb and a node N307 and coupled to the second output voltage Vb and the voltage of the node N307.

The voltage level of the node N307 is determined by the sixth through eighth switches S304, S406, and S308 which are a second level transfer portion 310. The sixth switch S304 transfers a ground voltage VSS level to the node N307 in response to the fourth control signal tpre21. The seventh switch S306 transfers the first output voltage Va to the node N307 in response to a fifth control signal trump21*a*. The eighth switch S308 transfers the reference voltage Vref to the node N307 in response to a sixth control signal tpump21*b*.

The second output voltage Vb is transferred to a node N311 via the ninth switch S310 in response to a seventh control signal tpre22. The third capacitor C311 is connected between the node 311 and a node N315 and coupled to the voltage level of the node N311 and the voltage level of the voltage of the node N315. The voltage level of the node N315 is determined by the tenth and eleventh switches S312 and S314 which constitute a third level transfer portion 320. The tenth switch S314 transfers the ground voltage VSS to the node N315 in response to a seventh control signal tpre22. The eleventh switch S316 transfers the first output voltage Va to the node N315 in response to an eighth control signal tpump22.

The second output voltage Vb is transferred to the third output voltage Vc via the twelfth switch S318 in response to a ninth control signal tpass21. The voltage level of the node N311 is transferred to the third output Vc via the thirteenth switch S316 in response to a tenth control signal tpass22.

FIGS. 5 through 8 are operation timing diagrams of the second positive voltage generator of FIG. 4. It is assumed that the first output voltage Va is set to a 2×Vref level.

FIG. 5 shows a case in which both the second output voltage Vb and the third output voltage Vc are generated to a 3 ×Vref level. Referring to FIG. 5, in a first section, while the fourth control signal tpre21 only is a logic high level and the other control signals such as tpump21*b*, tpump 21*a*, and so on are logic low levels, the node N307, the second output voltage Vb, and the third output voltage Vc are indicated as 0V, a 2×Vref level, and 0V, respectively. In a second section, while the fourth control signal tpre21 is a logic low level and the sixth and ninth control signals tpump21*b* and tpass21 are logic high levels, the node N307, the second output voltage Vb coupled to the voltage level of the node N307, and the third output voltage Vc are indicated as a 2×Vref level, a 2×Vref+ΔV1 level, and the 2×Vref+ΔV1 level which is the same as the level of the second output voltage Vb, respectively. After the first and second sections are repeated several times, in a section j, the second output voltage Vb and the third output voltage Vc are indicated as a 3×Vref level.

FIG. 6 shows a case in which both the second output voltage Vb and the third output voltage Vc are generated to a 4×Vref level. Referring to FIG. 6, in a first section, while the fourth control signal tpre21 only is a logic high level and the other control signals such as tpump21*b*, tpump21*a*, and so on are logic low levels, the node N307, the second output voltage Vb, and the third output voltage Vc are indicated as 0V, a 2×Vref level, and 0V, respectively. In a second section, while the fourth control signal tpre21 is a logic low level and the fifth and ninth control signals tpump21*a* and tpass21 are logic high levels, the node N307, the second output voltage Vb coupled to the voltage level of the node N307, and the third output voltage Vc are indicated as a 2×Vref level, a 2×Vref+ΔV1 level, and the 2×Vref+ΔV1 level which is the same as the level of the second output voltage Vb, respectively. After the first and second sections are repeated several times, in a section k, the second output voltage Vb and the third output voltage Vc are indicated as a 4×Vref level.

FIG. 7 shows a case in which the second output voltage Vb and the third output voltage Vc are generated to a 3×Vref level and a 5×Vref level, respectively. Referring to FIG. 7, in a first section, while the fourth control signal tpre21 is a logic high level, the eight control signal tpump22 is a logic high level, the tenth control signal tpass22 is a logic high level, and the other control signals such as tpump21*a*, tpump21*b*, and so on are logic low levels, the node N307, the node N315, the node N311, the second output voltage Vb, and the third output voltage Vc are indicated as 0V, a 2×Vref level, the 2×Vref level, the 2×Vref level, and the 2×Vref level, respectively. In a second section, while the fourth control signal tpre21 is a logic low level, the sixth control signal tpump21*b* is a logic high level, the seventh control signal tpre22 is a logic high level, the eighth control signal tpump22 is a logic low level, and the tenth control signals tpass22 is a logic low level, the node N307, the node N315, the second output voltage Vb coupled to the voltage level of the node N307, the node N311 to which the second output voltage Vb is transferred, and the third output voltage Vc are indicated as a Vref level, 0V, a 2×Vref+ΔV1 level, the 2×Vref+ΔV1 level, and the 2×Vref level, respectively. After the first and second sections are repeated several times, in a section I, the second output voltage Vb and the third output voltage Vc are indicated as a 3×Vref level and a 5×Vref level, respectively.

FIG. 8 shows a case in which the second output voltage Vb and the third output voltage Vc are generated to a 4×Vref level and a 6×Vref level, respectively. Referring to FIG. 8, in a first section, while the fourth control signal tpre21 is a logic high level, the eight control signal tpump22 is a logic high level, the tenth control signal tpass22 is a logic high level, and the other control signals such as tpump21*a*, tpump21*b*, and so on are logic low levels, the node N307, the node N315, the node N311, the second output voltage Vb, and the third output voltage Vc are indicated as 0V, a 2×Vref level, the 2×Vref level, the 2×Vref level, and the 2×Vref level, respectively. In a second section, while the fourth control signal tpre21 is a logic low level, the fifth control signal tpump21*a* is a logic high level, the seventh control signal tpre22 is a logic high level, the eighth control signal tpump22 is a logic low level, and the tenth control signals tpass22 is a logic low level, the node N307, the node N315, the second output voltage Vb coupled to the voltage level of the node N307, the node N311 to which the second output voltage Vb is transferred, and the third output voltage Vc are indicated as a 2×Vref level, 0V, a 2×Vref+ΔV1 level, the 2×Vref+ΔV1 level, and the 2×Vref level, respectively. After the first and second sections are repeated several times, in a section m, the second output voltage Vb and the third output voltage Vc are indicated as a 4×Vref level and a 6×Vref level, respectively.

FIG. 9 is a circuit diagram of a negative voltage generator of FIG. 1. Referring to FIG. 9, a negative voltage generator 400 includes fourteenth through nineteenth switches S402, S404, S406, S408, S410, and S412 and a fourth capacitor C405. The fourteenth switch S402 transfers the reference voltage Vref to a node N405 in response to an eleventh control signal tpre3*a*. The fifteenth switch S404 transfers the ground voltage VSS to the node N405 in response to a twelfth control signal tpre3*b*. The fourth capacitor C405 is connected between the node N405 and the node N407 and coupled to the voltage levels of the node N405 and the node N407.

The voltage level of the node N407 is determined by the sixteenth through eighteenth switches S406, S408, and S410. The sixteenth switch S406 transfers the third output voltage Vc to the node N407 in response to the thirteenth control signal tpre3*c*. The seventeenth switch S406 transfers the second output voltage Vb to the node N407 in response to the fourteenth control signal tpre3*d*. The eighteenth switch S410 transfers the ground voltage VSS to the node N407 in response to the fifteenth control signal tpump3. The nineteenth switch S412 transfers the voltage level of the node N405 to the fourth output Vd in response to the sixteenth control signal tpass3.

FIGS. 10 through 13 are timing diagrams of the negative voltage generator 400 of FIG. 9

FIG. 10 shows a case in which the fourth output voltage Vd is generated as a negative voltage of the third output voltage Vc. Referring to FIG. 10, in a first section, while the eleventh control signal tpre3*a* is a logic low level, the twelfth and thirteenth control signals tpre3*b* and tpre3*c* are logic high levels, and the fourteenth through sixteenth control signals tpre3*d*, tpump3, and tpass3 are logic low levels, the node N407, the node N405, and the fourth output signal Vd are indicted as a Vc level, a 0V level, and the 0V level, respectively. In a second section, while the twelfth and thirteenth control signals tpre3*b* and tpre3*c* are logic low levels and the fifteenth and sixteenth control signals tpump3 and tpass3 are logic high levels, the node N407, the node N405 coupled to the voltage level of the node N407, and the fourth output signal Vd to which the voltage level of the node N405 is transferred are indicated as 0V, a −ΔV1 level, and the −ΔV1 level, respectively. After the first and second sections are repeated several times, in a section n, the fourth output voltage Vd is indicated as a negative voltage of the third output voltage Vc.

FIG. 11 shows a case in which the fourth output voltage Vd is generated as a negative voltage of the second output voltage Vb. Referring to FIG. 11, in a first section, while the eleventh control signal tpre3*a* is a logic low level, the twelfth control signal tpre3*b* is a logic high level, the thirteenth control signal tpre3*c* is a logic low level, the fourteenth control signal tpre3*d* is a logic high level, and the fifteenth and sixteenth control signals tpump3 and tpass3 are logic low levels, the node N407, the node N405, and the fourth output signal Vd are indicated as a Vb level, a 0V level, and the 0V level, respectively. In a second section, while the twelfth and fourteenth control signals tpre3*b* and tpre3*d* are logic low levels and the fifteenth and sixteenth control signals tpurnp3 and tpass3 are logic high levels, the node N407, the node N405 coupled to the voltage level of the node N407, and the fourth output signal Vd to which the voltage level of the node N405 is transferred are indicated as a 0V level, a −ΔV1 level, and the −ΔV1 level, respectively. After the first and second sections are repeated several times, in a section o, the fourth output voltage Vd is indicated as a negative voltage of the second output voltage Vb.

FIG. 12 shows a case in which the fourth output voltage Vd is generated as Voltage level (Vc−Vref) obtained by subtracting the reference voltage Vref from the negative voltage of the third output voltage Vc. Referring to FIG. 12, in a first section, while the eleventh control signal tpre3*a* is a logic high level, the twelfth control signal tpre3*b* is a logic low level, the thirteenth control signal tpre3*c* is a logic high level, the fourteenth control signal tpre3*d* is a logic low level, and the fifteenth and sixteenth control signals tpump3 and tpass3 are logic low levels, the node N407, the node N405, and the fourth output signal Vd are indicated as a Vc level, a Vref level, and a 0V level, respectively. In a second section, while the eleventh and thirteenth control signals tpre3*a* and tpre3*c* are logic low levels and the fifteenth and sixteenth control signals tpump3 and tpass3 are logic high levels, the node N407, the node N405 coupled to the voltage level of the node N407, and the fourth output signal Vd to which the voltage level of the node N405 is transferred are indicated as a 0V level, a Vref−ΔV1 level, and the Vref−ΔV1 level, respectively. After the first and second sections are repeated several times, in a section p, the fourth output voltage Vd is indicated as a voltage level (−|Vc−Vref|) obtained by subtracting the reference voltage Vref from a negative voltage of the third output voltage Vc.

FIG. 13 shows a case in which the fourth output voltage Vd is generated as Voltage level (Vb−Vref) obtained by subtracting the reference voltage Vref from the negative voltage of the second output voltage Vb. Referring to FIG. 13, in a first section, while the eleventh control signal tpre3*a* is a logic high level, the twelfth control signal tpre3*b* is a logic low level, the thirteenth control signal tpre3*c* is a logic low level, the fourteenth control signal tpre3*d* is a logic high level, and the fifteenth and sixteenth control signals tpump3 and tpass3 are logic low levels, the node N407, the node N405, and the fourth output signal Vd are indicated as a Vb level, a Vref level, and a 0V level, respectively. In a second section, while the eleventh and fourteenth control signals tpre3*a* and tpre3*d* are logic low levels and the fifteenth and sixteenth control signals tpump3 and tpass3 are logic high levels, the node N407, the node N405 coupled to the voltage level of the node N407, and the fourth output signal Vd to which the voltage level of the node N405 is transferred are indicated as a 0V level, a Vref−ΔV1 level, and the Vref−ΔV1 level, respectively. After the first and second sections are repeated several times, in a section q, the fourth output voltage Vd is indicated as a voltage level (−|Vb−Vref|) obtained by subtracting the reference voltage Vref from a negative voltage of the second output voltage Vb.

Thus, the multilevel voltage generator wording to the present invention Includes the first positive voltage generator 200, the second positive voltage generator 300, and the negative voltage generator 400, each of which including the capacitors C203, C303 and C311, and C405, respectively, and generates the first output voltage Va having a 2×Vref level which is twice the reference voltage Vref, the second output voltage Vb having a 3×Vref or 4×Vref level which is three or four times of the reference voltage Vref, the third output voltage Vc having a 3×Vref, 4×Vref, 5×Vref, or 6×Vref level which is three, four, five, or six times of the reference voltage Vref, the negative voltage of the third output voltage Vc, the negative voltage of the second output voltage Vb, and the fourth output voltage Vd having a voltage level (Vc−Vref)

obtained by subtracting the reference voltage Vref from the negative voltage of the third output voltage Vc or a voltage level (Vb−Vref) obtained by subtracting the reference voltage Vref from the negative voltage of the second output voltage Vb.

As described above, awarding to the multilevel voltage generator according to The present invention, a variety of voltage levels such as the first through third output voltages which are two, three, four, five, or six times of the reference voltage, the negative second output voltage, the negative third output voltage, and the fourth output voltage having a voltage level obtained by subtracting the reference voltage from the negative second output voltage or a voltage level obtained by subtracting the reference voltage from the negative third output voltage are generated wording to the voltage level charging the capacitor by a combination of the control signals. That is, by generating a variety of voltage levels using one capacitor, the number of the constituent elements of the multilevel voltage generator are reduced.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. A multilevel voltage generator comprising:

a first positive voltage generator generating a first output voltage corresponding to two times of a reference voltage by using a first capacitor which receives a reference voltage and is switched according to a control signal to be charged to a voltage level of the reference voltage applied to two terminals of the first capacitor;

a second positive voltage generator generating a second output voltage and a third output voltage using a second capacitor and a third capacitor which receive the first output voltage and are charged to voltage levels corresponding to predetermined multiples of the reference voltage; and a negative voltage generator generating a fourth output voltage having predetermined negative voltage levels using a fourth capacitor which receives the reference voltage, the second output voltage, or the third output voltage and is charged to a voltage level corresponding to a negative voltage of the second or third output voltage;

wherein the first positive voltage generator comprises:

a first switch transferring the reference voltage to a first node in response to a first control signal;

the first capacitor connected between the first node and a second node and charged to the reference voltage that is transferred to the first node;

a first level transfer portion transferring a ground voltage or the reference voltage to the second node in selective response to the first control signal and a second control signal; and a second switch transferring a voltage level of the first node to a first output in response to a third control signal;

wherein the first level transfer portion comprises:

a third switch transferring the ground voltage to the second node in response to the first control signal; and a fourth switch transferring the reference voltage to the second node in response to the second control signal;

wherein the second positive voltage generator comprises:

a fifth switch transferring the first output voltage to the second output voltage in response to a fourth control signal;

the second capacitor connected between the second output voltage and a third node and charged to the second output voltage; and a second level transfer portion transferring the ground voltage, the first output voltage, or the reference voltage to the third node in response to the fourth control signal, a fifth control signal, and a sixth control signal;

wherein the second level transfer portion comprises:

a sixth switch transferring the ground voltage to the third node in response to the fourth control signal;

a seventh switch transferring the first output voltage to the third node in response to the fifth control signal; and an eighth switch transferring the reference voltage to the third node in response to the sixth control signal;

wherein the second positive voltage generator comprises:

a ninth switch transferring the second output voltage to a fourth node in response to a seventh control signal;

the third capacitor connected between the fourth node and a fifth node and charged to the second output voltage that is transferred to the fourth node;

a third level transfer portion transferring the ground voltage or the first output voltage to the fifth node in response to the seventh control signal or an eighth control signal;

a tenth switch transferring the second output voltage to a third output in response to a ninth control signal; and an eleventh switch transferring a voltage level of the fourth node to the third output in response to a tenth control signal;

wherein the third level transfer portion comprises:

a twelfth switch transferring the ground voltage to the fifth node in response to the seventh control signal; and a thirteenth switch transferring the first output voltage to the fifth node in response to the eighth control signal;

wherein the negative voltage generator comprises:

a fourteenth switch transferring the reference voltage to a sixth node in response to an eleventh control signal;

a fifteenth switch transferring the ground voltage to the sixth node in response to a twelfth control signal;

the fourth capacitor connected between the sixth node and a seventh node and charged to the reference voltage or the ground voltage that is transferred to the sixth node;

a fourth level transfer portion transferring the third output voltage, the second output voltage, or the ground voltage to the seventh node in selective response to a thirteenth control signal, a fourteenth control signal, or a fifteenth control signal; and a sixteenth switch transferring a voltage level of the sixth node to the fourth output in response to a sixteenth control signal.

2. The multilevel voltage generator of claim 1, wherein the fourth level transfer portion comprises:

a seventeenth switch transferring the third output voltage to the seventh node in response to the thirteenth control signal;

an eighteenth switch transferring the second output voltage to the seventh node in response to the fourteenth control signal; and a nineteenth switch transferring the ground voltage to the seventh node in response to the fifteenth control signal.

* * * * *